US005472652A

United States Patent [19]

Yoshimura

[11] Patent Number: 5,472,652

[45] Date of Patent: Dec. 5, 1995

[54] METHOD OF CONTINUOUSLY REINFORCING SLIDE FASTENER TAPE ENDS HAVING SEPARABLE BOTTOM STOP ASSEMBLY

[75] Inventor: Eiichi Yoshimura, Toyama, Japan

[73] Assignee: Yoshida Kogyo K.K., Tokyo, Japan

[21] Appl. No.: 169,054

[22] Filed: Dec. 20, 1993

[30] Foreign Application Priority Data

Dec. 22, 1992 [JP] Japan ..... 4-342596

[51] Int. Cl.[6] ..... B29D 5/00

[52] U.S. Cl. ..... 264/136; 24/434; 264/145; 264/252; 264/328.1; 425/289; 425/545; 425/814

[58] Field of Search ..... 264/135, 136, 264/137, 252, 145, 328.1; 425/814, 545, 289; 24/434, 436

[56] References Cited

U.S. PATENT DOCUMENTS

| | | | |
|---|---|---|---|
| 1,813,433 | 7/1931 | Sundback | 24/434 |
| 2,082,619 | 6/1937 | Dav | 425/814 |
| 2,169,178 | 8/1939 | Sundback | 425/814 |
| 3,103,728 | 9/1963 | Wahl | 24/397 |
| 3,219,743 | 11/1965 | Berler | 425/814 |
| 3,503,102 | 3/1970 | Inazawa | 24/434 |
| 3,804,577 | 4/1974 | Gaus | 425/814 |
| 4,078,109 | 3/1978 | Kando et al. | 428/62 |
| 4,163,768 | 8/1979 | Stephens | 425/814 |
| 4,325,173 | 4/1982 | Kirii | 29/408 |
| 4,641,424 | 2/1987 | Sodeno et al. | 425/814 |
| 4,978,288 | 12/1990 | Mayerhofer | 29/769 |
| 5,054,183 | 10/1991 | Mayerhofer | 29/410 |
| 5,079,820 | 1/1992 | Mayerhofer | 29/410 |
| 5,231,737 | 8/1993 | Frohlich et al. | 24/434 |

FOREIGN PATENT DOCUMENTS

| | | |
|---|---|---|
| 0356600A1 | 3/1990 | European Pat. Off. . |
| 2441357 | 6/1980 | France . |
| 446790 | 3/1968 | Switzerland . |

*Primary Examiner*—Jay H. Woo
*Assistant Examiner*—Duane S. Smith
*Attorney, Agent, or Firm*—Hill, Steadman & Simpson

[57] ABSTRACT

As a pair of fastener tapes is supplied through a molding machine and then through a fiber hardening agent applying and impregnating unit, a predetermined length of coupling element rows are molded on and along confronting beaded edges of the fastener tapes, and simultaneously a separable bottom stop assembly composed of a pin member and a box member and top stops are molded about one ends and the other ends of the coupling element rows, whereupon a fiber hardening agent is applied over and impregnated in the tape surfaces of the prospective bottom end portions by the fiber hardening agent applying and impregnating unit.

2 Claims, 3 Drawing Sheets

METHOD OF CONTINUOUSLY REINFORCING SLIDE FASTENER TAPE ENDS HAVING SEPARABLE BOTTOM STOP ASSEMBLY

BACKGROUND OF THE INVENTION

1. Field of the Invention

This invention relates to a new and effective method of reinforcing a pair of opposed fastener tapes at and about their prospective bottom ends, to which a separable bottom stop assembly is to be molded, in manufacturing a continuous separable slide fastener chain by injection molding coupling element rows along confronting inner edges of the opposed fastener tapes being continuously supplied and a separable bottom stop assembly, which is composed of a pin member and a box member, on prospective bottom ends of the fastener tapes.

2. Description of the Related Art

Conventionally, in this type of slide fastener with a separable bottom stop assembly composed of a pin member and a box member, the fastener tape portions to which the separable bottom stop assembly is attached are reinforced to prevent such tape surfaces from being damaged.

To this end, it has been a common practice to stick reinforcement tape pieces such as synthetic resin film or woven fabric to the tape surfaces.

However, in this reinforcing method, as disclosed in, for example, Japanese Patent Laid-Open Publication No. HEI 2-153725, the reinforcement tape pieces are stuck to the fastener tapes by a reinforcement tape sticking machine, whereupon the resulting fastener tapes are fed to an injection molding machine independent of the reinforcement tape sticking machine. Then, in the injection molding machine, coupling element rows and a separable bottom stop are molded in order along the confronting inner edges of the reinforced fastener tapes.

Generally, between the reinforcement tape sticking machine and the injection molding machine, small holes are formed in the reinforced prospective bottom end portions in an attempt to secure an increased degree of peel strength of the separable bottom stop assembly on the fastener tapes. Further, another solution has been proposed by, for example, West German Patent Specification No. 635026, in which lattice ribs instead of the reinforcement tape pieces are molded on the fastener tapes simultaneously with the molding of the separable bottom stop assembly. Of course, reinforcement plates may be substituted for the lattice ribs.

In still another solution, as proposed by, for example, Japanese Utility Model Publication No. SHO 50-10888, the prospective bottom end portions of the opposed fastener tapes are treated by a synthetic resin process, whereupon generally E-shape ribs instead of the lattice ribs are molded on the synthetic resin treated portions.

However, according to the slide fastener chain manufacturing method disclosed in Japanese Patent Laid-Open Publication No. HEI 2-153725, the step of sticking the reinforcement tape pieces to the fastener tapes and the step of injection molding the separable bottom stop assembly are independent of each other and must take place continuously for a long period in timed relation to each other. Since the fastener tapes would be stretched or shrunk as they are subject to a predetermined amount of tension or are relaxed during the individual step, it is almost impossible to match the reinforcement tape sticking position with the separable bottom stop molding position.

According to the slide fastener chain manufacturing method disclosed in West German Patent Specification No. 635026, since the reinforced fastener tape end portions and the separable bottom stop assembly are molded simultaneously, no meticulous control is required for the above-mentioned positioning, thus improving the rate of production. However, assuming that the slide fastener manufactured by this method is sewn to a garment or the like, since the reinforced tape portion would have a thickness sharply larger than that of the fastener tape and would become rigid, it tends to be caught by the pressure foot of a sewing machine so that the sewing needle can be broken on many occasions. Yet if soft molding material could be used in an effort to avoid this breakage of the needle, the separable bottom stop would have been too soft for practical use.

The slide fastener chain manufacturing method disclosed in Japanese Utility Model Publication No. SHO 50-10888 has the same problems with those with the above-mentioned West German Patent and is difficult to secure positioning accuracy as well as the method disclosed in Japanese Patent Laid-Open Publication No. HEI 2-153725.

SUMMARY OF THE INVENTION

It is therefore an object of this invention to provide a method of continuously reinforcing opposed tape ends of a slide fastener chain having a separable bottom stop, which secures an adequate degree of peeling strength of the separable bottom stop with respect to the faster tapes, also secures adequate rigidness of the separable bottom stop, adequately reinforces the fastener tape surfaces of the separable bottom stop molding portion, and are free of any trouble such as breakage of the sewing needle during sewing operation.

According to this invention, there is provided a method of continuously reinforcing opposed slide fastener tape ends having a separable bottom stop assembly in manufacturing a separable slide fastener chain by molding coupling element rows and then a separable bottom stop assembly on confronting beaded edges of the slide fastener tapes being continuously supplied, wherein next to the molding of the coupling element rows and separable bottom stop assembly, a fiber hardening agent is impregnated and fixed in and about prospective bottom ends of the fastener tapes.

In operation, as a pair of fastener tapes is supplied through the molding machine, which is situated on the upstream side, and then through a fiber hardening agent applying and impregnating unit by, for example, a plurality of feed rollers which are controllably driven, a predetermined length of coupling element rows are molded on and along confronting beaded edges of the fastener tapes, and simultaneously a separable bottom stop assembly composed of a pin member and a box member and top stops are molded on and about one ends and the other ends of the coupling element rows, whereupon a fiber hardening agent is applied over and impregnated in the tape surfaces of the prospective bottom end portions by the fiber hardening agent applying and impregnating unit.

Preferably the fiber hardener is applied to a range slightly beyond the bottom end portions on which the separable bottom stop assembly is to be molded. In this case, when the slide fastener chain is finished as slide fasteners in a subsequent finishing station the upper end portions of the fastener tapes are impregnated and hardened with the fiber hardening agent and hence are prevented from fraying.

DETAILED DESCRIPTION

Figure 1:
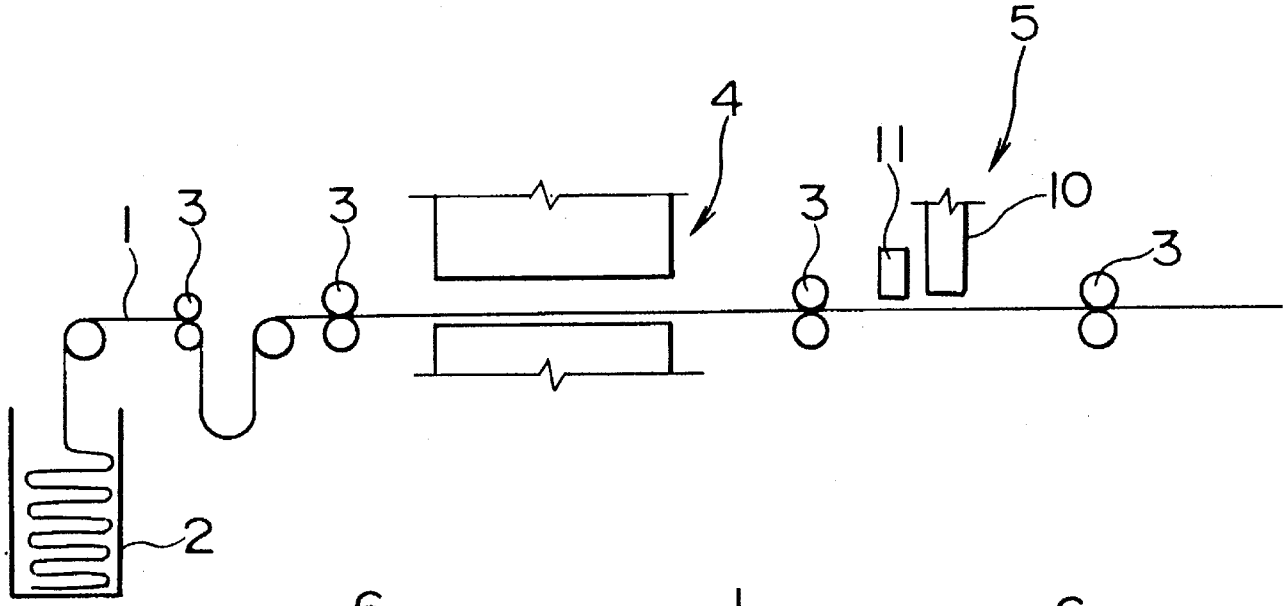
FIG. 1 is a fragmentary diagram showing, as a typical example, a method of continuously reinforcing opposed fastener tape ends of a slide fastener chain having a separable bottom stop assembly according to this invention.
Figure 2:
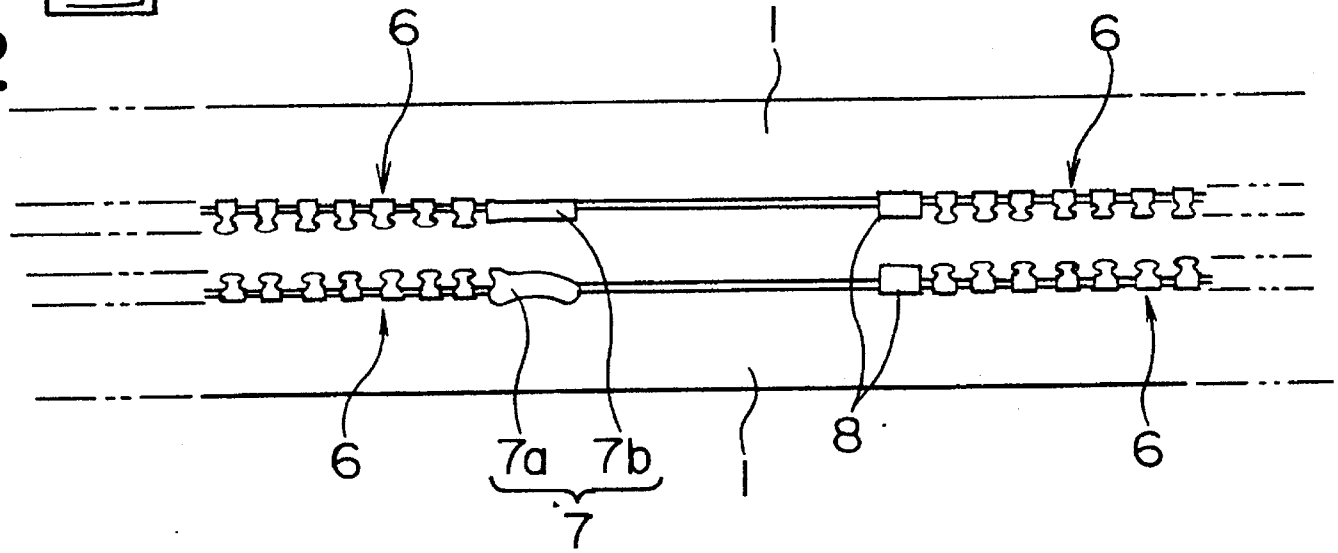
FIG. 2 is a fragmentary plan view showing the slide fastener chain after the molding has been completed.
Figure 3:
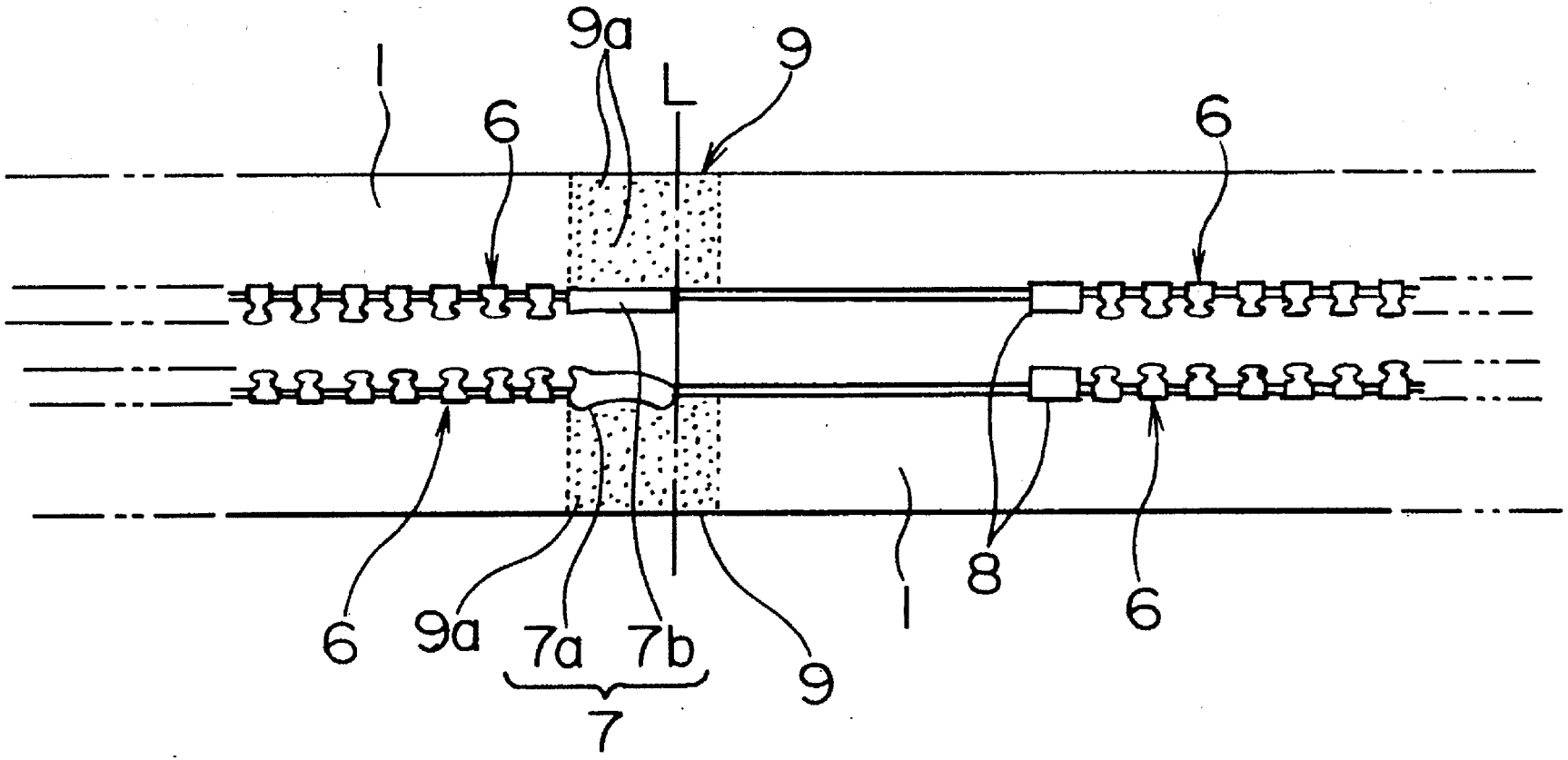
FIG. 3 is a fragmentary plan view showing the slide fastener chain after the tapes have been reinforced according to the method of this invention.
Figure 4:
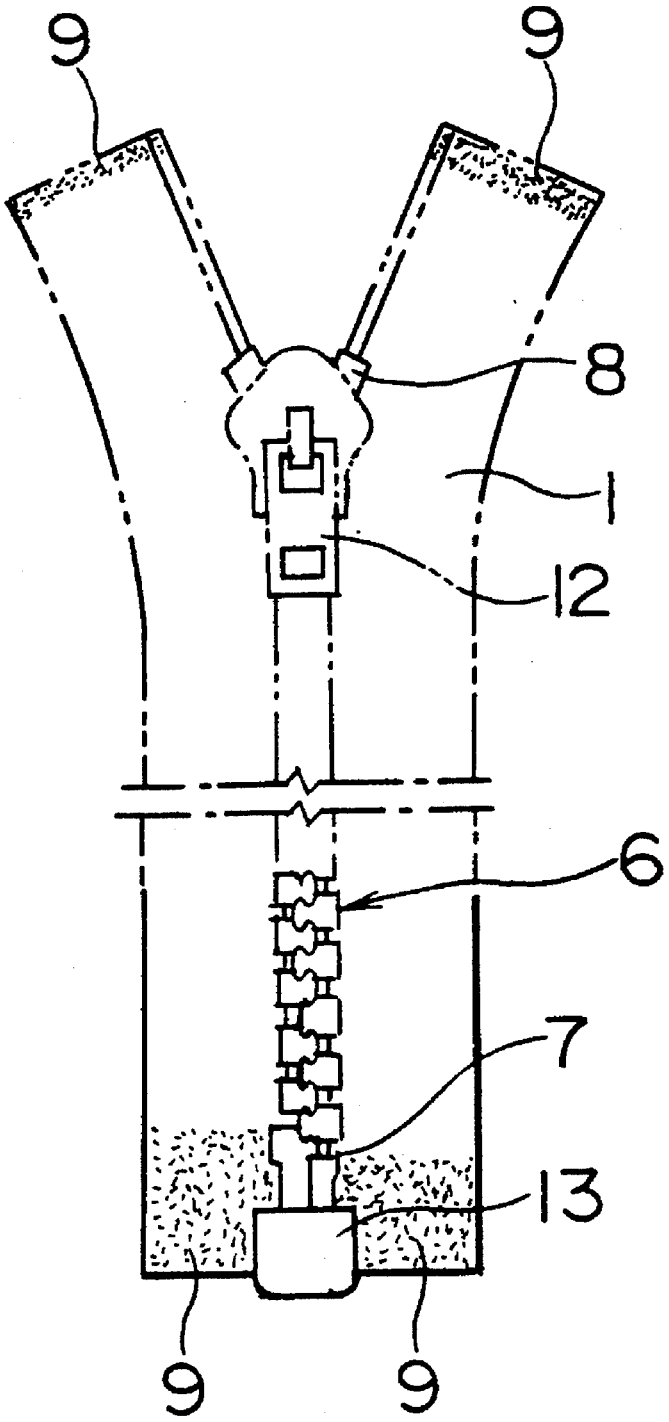
FIG. 4 is a plan view, partly omitted, of a slide fastener whose tapes have been reinforced according to the method of this invention.

One embodiment of this invention will now be described in detail with reference to the accompanying drawings. FIG. 1 is a diagram showing part of slide fastener chain manufacturing processes embodying this invention. FIG. 2 is a fragmentary plan view of a continuous slide fastener chain including a pair of fastener tapes on which coupling element rows and a separable bottom stop assembly are simultaneously molded. FIG. 3 is a fragmentary plan view of the continuous slide fastener chain, showing the fastener tape surfaces of the separable bottom stop assembly forming portions in which a fiber hardening agent has been impregnated and fixed. In this embodiment, the coupling elements and separable bottom stop assembly are formed of synthetic resin. Alternatively, both the coupling element and separable bottom stop assembly may be formed of metal, in which case die cast molding should be substituted for injection molding.

In FIG. 1, reference numeral 1 designates a continuous length of fastener tapes (only one shown) each being supplied from a coiler can 2. The fastener tapes 1 are simultaneously drawn from the respective coiler cans 2 by a plurality of controllably driven feed rollers 3 and are supplied in order through an injection molding machine 4, which is situated on the upstream side, and a fiber hardening agent applying and impregnating unit 5. In the injection molding machine 4, a predetermined length of coupling element rows 6 are molded on confronting beaded edges of the two fastener tapes 1, and simultaneously a pin member 7*a* and a box member 7*b* are molded on one end portions of the coupling element rows 6 which top stops 8 are molded on the other end portions of the coupling element rows 6 (FIG. 2). Then in the fiber hardening agent applying and impregnating unit 5, a fiber hardening agent 9*a* is applied over and impregnated in the tape surfaces at portions to which the pin member 7*a* and the box member 7*b* have been molded, thus forming reinforced tape portions 9 (FIG. 3).

Since the molding technology for the coupling element rows 6, the pin member 7*a*, the box member 7*b* and the top stops 8 by the injection molding machine is substantially identical with that disclosed in Japanese Patent Laid-Open Publication No. HEI 2-153725 and West German Patent Specification No. 635026, its detailed description is omitted here for clarity. Only the technology of applying the fiber hardening agent 9*a* by the fiber hardening agent applying and impregnating unit 5 will now be described.

The fiber hardening agent applying technology may use any of various conventional methods. In the illustrated example, a stamping method is used. A stamping unit 10 used in this stamping method has, though omitted in the drawings, a through-hole for flow of the fiber hardening agent 9*a* and an end opening of the through-hole in which a porous elastic material such as sponge holding the fiber hardening agent 9*a* is fitted. When the arrival of the separable bottom stop assembly 7 composed of the pin member 7*a* and the box member 7*b* at the stamping position is detected by a photoelectric detector 11 situated upstream of the stamping unit 10, an actuating instruction is generated from a non-illustrated control unit upon receipt of a detection signal, so that the stamping unit 10 is actuated in such a manner that the stamping unit 10 is lowered to the tape surfaces to press it at a predetermined position. At that time, the fiber hardening agent 9*a* held in the porous elastic material is transferred onto the tape surfaces and is then impregnated there to form reinforced tape portions 9. The fiber hardening agent 9*a* impregnated into the tapes is then hardened by a non-illustrated heating unit such as a hot press or a hot air blower, whereupon the resulting slide fastener chain will be supplied to a subsequent station.

This invention should by no means be limited to the stamping unit 10; for example, an ordinary spraying method or a dripping method may be used. Further, in this embodiment, an emulsion of acrylic acid ester copolymer resin, which is generally known as a binder for non-woven fabric, is used for the fiber hardening agent 9*a*. The invention is not limited to this substance. But acrylic acid ester copolymer resin is resistant against dry cleaning and weather and has adequate softness, and so it is suitable for the fiber hardening agent in view of drastic change of environment as well as convenience in sewing operation.

In the method for continuously reinforcing the opposed tape ends of a slide fastener chain having the separable bottom stop assembly according to this invention, the range of application of the fiber hardening agent 9*a* is preferebly positively extended slightly beyond the separable bottom stop assembly 7 toward the top stops 8, as shown in FIG. 3, rather than the portion exactly where the separable bottom stop assembly 7 is attached. In this case, since the fastener tapes 1 are cut at a position downstream of the separable bottom stop assembly 7 (right end in FIG. 3) as indicated by a phantom line L in a subsequent station, the upper end portion of the fastener tapes are impregnated and hardened by the fiber hardening agent 9*a* and hence is prevented from fraying.

As is apparent from the foregoing description, according to the fastener tape end reinforcing method of this invention, since the tapes are reinforced after the separable bottom stop assembly is molded on the fastener tapes, it is possible to remarkably reduce occurrences of faulty products and to rationalize the manufacturing processes for this type of slide fastener chain having a separable bottom stop assembly. Since part of the fiber hardening agent applied over the tape surfaces is stuck also to the separable bottom stop assembly, it is possible to improve the adhesive strength and the bending strength between the separable bottom stop assembly and the fastener tapes.

With an increased degree of hardness of the hardened fastener tape portions, it is possible not only to prevent such tape end portions from fraying when the tapes are cut, but also to thread one tape end portion through the slider and into the box smoothly like the conventional art using the reinforcing tape pieces. Further, by selecting a suitable substance for the fiber hardening agent, it is possible to secure adequate softness of the tapes, eliminating the risk that the sewing needle will be broken while the tapes are being sewn to a garment. Furthermore, if the range of application of the fiber hardening agent is extended slightly beyond the separable bottom stop assembly, it is possible to prevent the cut tape ends of a slide fastener as a final product from fraying.

What is claimed is:

1. A method of continuously reinforcing opposed slide fastener tape ends having a separable bottom stop assembly in manufacturing of a separable slide fastener chain by molding coupling element rows and a separable bottom stop assembly on confronting beaded edges of the slide fastener tapes being continuously supplied, comprising the steps of:

drawing a continuous train of connected slide fastener tapes in a processing direction;

injection molding coupling element rows and a separable bottom stop assembly simultaneously at a molding station; and downstream of the molding station, impregnating a heat activated fiber hardening agent into the fastener tapes in a narrow band across the tape which includes the bottom stop assembly.

2. The method according to claim 1 comprising the further step of cutting and separating adjacent slide fastener tapes at a cut line, and wherein said narrow band extends across said cut line between adjacent fastener tapes.

* * * * *